US009521867B2

(12) United States Patent
Xiang

(10) Patent No.: US 9,521,867 B2
(45) Date of Patent: Dec. 20, 2016

(54) ELECTRONIC CIGARETTE LIGHT CAP AND ELECTRONIC CIGARETTE USING THE SAME

(71) Applicant: Zhiyong Xiang, Guangdong (CN)

(72) Inventor: Zhiyong Xiang, Guangdong (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 822 days.

(21) Appl. No.: 13/901,280

(22) Filed: May 23, 2013

(65) Prior Publication Data

US 2014/0290675 A1 Oct. 2, 2014

Related U.S. Application Data

(63) Continuation of application No. PCT/CN2013/073558, filed on Apr. 1, 2013.

(51) Int. Cl.
*A24F 47/00* (2006.01)

(52) U.S. Cl.
CPC ..... *A24F 47/008* (2013.01)

(58) Field of Classification Search
CPC ... A24F 47/002; A24F 47/008; A61M 11/042; A61M 15/06
USPC ..... 131/329; 128/202.21
See application file for complete search history.

(56) References Cited

FOREIGN PATENT DOCUMENTS

| | | | |
|---|---|---|---|
| CN | 200997909 | Y | 1/2008 |
| CN | 202262413 | U | 6/2012 |
| CN | 202445136 | U | 9/2012 |
| WO | 0139619 | A1 | 6/2001 |

OTHER PUBLICATIONS

Translation of CN202262413.*
Translation of CN200997909.*
International Search Report mailed Jan. 9, 2014 in International Application No. PCT/CN2013/073558 filed Jan. 4, 2013.

* cited by examiner

*Primary Examiner* — Mohamed K Ahmed Ali
(74) *Attorney, Agent, or Firm* — Tim Tingkang Xia, Esq.; Locke Lord LLP

(57) ABSTRACT

The invention discloses an electronic cigarette light cap and an electronic cigarette, wherein the electronic cigarette comprises cigarette holder and a cigarette pipe comprising a tube body and an electronic cigarette light cap, and the electronic cigarette light cap comprises a top cover, and a hollow and bottomless cap column perpendicularly extending along a back side of the top cover, forming an annular stage around the cap column; at least one air inlet hole is defined in a front side of the top cover, and the air inlet hole is communicating with the cap column; the air introduced from the air inlet hole gets into the atomizing passageway via the first gap, forming the airflow path. By implementing the electronic cigarette light cap and the electronic cigarette, the air flow may get retained to be unobstructed, smoking noise caused by obstructed airflow gets reduced, which improves the users' experience.

5 Claims, 5 Drawing Sheets

ELECTRONIC CIGARETTE LIGHT CAP AND ELECTRONIC CIGARETTE USING THE SAME

CROSS-REFERENCE TO RELATED APPLICATIONS

This application is a continuation of International Patent Application No. PCT/CN2013/073558, with an international filing date of Apr. 1, 2013, designating the United States, now pending. The contents of these specifications are incorporated herein by reference.

FIELD OF THE INVENTION

This invention relates to the field of electronic commodity, and more particularly to an electronic cigarette light cap and an electronic cigarette using the same.

BACKGROUND OF THE INVENTION

With the promotion of healthy consciousness and popularization of smoking banning propaganda, electronic cigarettes configured to quit smoking and replace cigarette get more and more attention. A present cigarette generally has a united structure consisting of a cigarette rod and a cigarette holder. An atomizing device is received inside the cigarette holder electrically connected to the cigarette rod. A control circuit is mounted in the cigarette rod. By using the control circuit to supply power to the atomizing device, smoke is generated and provided to users to simulate smoking feeling. Furthermore, an LED light is mounted at an end of the cigarette rod. When the atomizing device generates smoke, the LED light lights to imitate the situation of burning cigarettes. A light cap is mounted on the LED light.

In the prior art, an air inlet hole or air inlet slot is formed on the lateral side of the light cap. In smoking processes, introducing air into the electronic cigarette through the lateral side of the light cap may jam the entering way of air flows, and further cause smoking noises to be enlarged. Meanwhile, when processing and manufacturing parts of electronic cigarettes, it may be difficult to form the air inlet hole or the air inlet hole in the lateral side of the light cap.

SUMMARY OF THE INVENTION

The object of the present invention is to provide an electronic cigarette light cap and an electronic cigarette using the same, aiming at the disadvantages of the prior art that larger noise may get caused for the jams in the air flow path.

The technical solution of the invention is as follows:

The invention discloses an electronic cigarette light cap, comprising a top cover and a hollow and bottomless cap column perpendicularly extending along a back side of the top cover; an annular stage formed around the cap column; at least one air inlet hole defined in a front side of the top cover, and the air inlet hole communicating with the cap column.

In the electronic cigarette light cap of the invention, an L-shaped connecting part connects the annular stage with the cap column.

In the electronic cigarette light cap of the invention, an outer surface of the cap column is configured for tightly attaching to an inner surface of a tube body of an electronic cigarette.

In the electronic cigarette light cap of the invention, the top cover, the cap column, and the connecting part are formed by integral forming.

In the electronic cigarette light cap of the invention, the at least one air inlet hole is shaped as at least one of square, circle, triangle, polygon and kidney.

In the electronic cigarette light cap of the invention, the at least one air inlet hole is defined in a front center of the top cover.

In the electronic cigarette light cap of the invention, the top cover is any one of a plane, a concavity or a convexity.

In the electronic cigarette light cap of the invention, the top cover is disk-shaped or arc-shaped.

The invention also provides an electronic cigarette, comprising a cigarette holder and a cigarette pipe, wherein the cigarette pipe comprises a tube body and an electronic cigarette light cap engaging with an end of the tube body, a first gap extending along an axial direction of the tube body formed between the electronic cigarette light cap and the tube body and configured for communicating the light cap with the tube body, and the first gap communicating with an atomizing passageway in the tube body, the electronic cigarette comprising a top cover and a hollow and bottomless cap column perpendicularly extending along a back side of the top cover; an annular stage formed around the cap column; at least one air inlet hole defined in a front side of the top cover, and the air inlet hole communicating with the cap column; air entering the atomizing passageway via the air inlet hole and the first gap, and forming an airflow path.

In the electronic cigarette of the invention, an L-shaped connecting part connects the annular stage with the cap column.

In the electronic cigarette of the invention, an outer surface of the cap column is configured for tightly attaching to an inner surface of a tube body of the electronic cigarette.

In the electronic cigarette of the invention, the top cover, the cap column, and the connecting part are formed by integral forming.

In the electronic cigarette of the invention, the at least one air inlet hole is shaped as at least one of square, circle, triangle, polygon and kidney.

In the electronic cigarette of the invention, the at least one air inlet hole is defined in a front center of the top cover.

In the electronic cigarette of the invention, the top cover is any one of a plane, a concavity or a convexity.

In the electronic cigarette of the invention, the top cover is disk-shaped or arc-shaped.

By implementing the electronic cigarette light cap and the electronic cigarette of the present invention, following advantages may be obtained: at least one air inlet hole is set on the front side of the electronic cigarette light cap, air can enter the airflow path through the at least one air inlet hole. In this way, the airflow path can be effectively retained to be unobstructed, and loud smoking noise caused by obstructed airflows is avoided, which improves users' experience.

DETAILED DESCRIPTION OF THE PREFERRED EMBODIMENT

To make the objective, technical solution and advantages of the invention more clearly understood, the invention is to be further described with reference to the accompanying drawings and embodiments. It should be acknowledged that the embodiments are configured to interpret the invention, and shall not be construed as limiting the invention.

Figure 1:
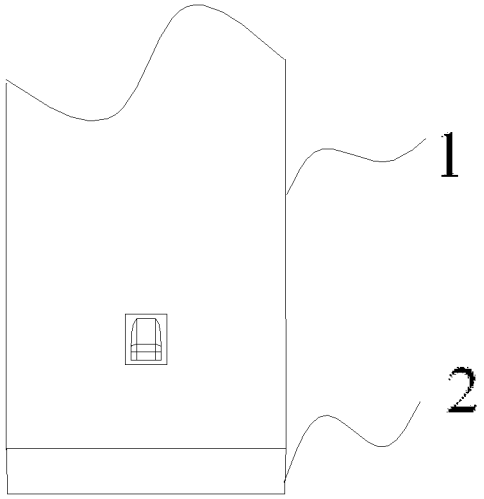
FIG. 1 illustrates a part of a structure of an electronic cigarette in accordance with a first preferable embodiment of the present invention.
Figure 2:
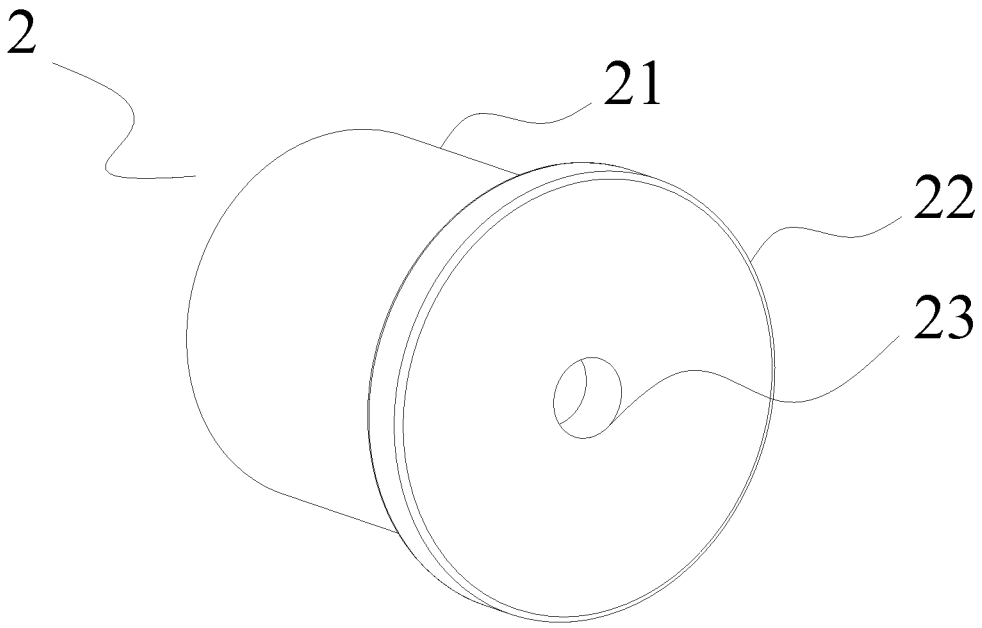
FIG. 2 illustrates a stereoscopic view of the electronic light cap 2 of the electronic cigarette shown in FIG. 1.
Figure 3:
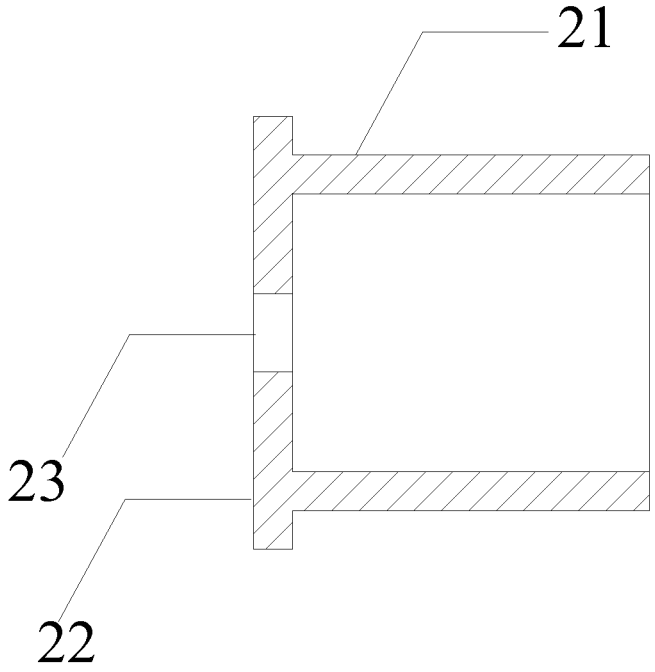
FIG. 3 illustrates a cutaway view of the electronic cigarette light cap 2 shown in FIG. 2.

Referring to FIGS. 1-3, in a first preferable embodiment of the invention, an electronic cigarette light cap 2 is approximately cylinder-shaped, and is mounted at a distal end of a tube body 1. The electronic cigarette light cap 2 comprises a disk-shaped top cover 22, and a hollow and bottomless cap column 21 perpendicularly extending along a bottom side of the top cover 22. An air inlet hole 23 is defined in a front side of the top cover 22. In this embodiment, the cigarette light cap 2 is made of materials having good corrosion resistance, such as silicone, resin, and rubber.

As shown in FIG. 2, the top cover 22 forms an annular stage around the cap column 21, and the air inlet hole 23 is defined in a center of the front side of the top cover 22. As shown in FIG. 3, in this embodiment, the number of the air inlet hole 23 is one, and the air inlet hole 23 is a shaped as a round. It should be understood that the air inlet hole 23 can also be shaped as square, kidney, rhombus, triangle, or polygon, or any other regular or irregular shape, and the specific shape of the air inlet hole can be decided according to practical requirements. An L-shaped connecting part connects the top cover 22 with the cap column 21. The cap column 21 is hollow, bottomless and cylinder-shaped, and an outer diameter of the cap column 21 matches an inner diameter of the tube body 1. When the electronic cigarette light cap 2 engages with the tube body 1, an outer surface of the cap column 21 fits and is tightly compressed on the inner surface of the tube body 1, thereby connecting the electronic cigarette light cap 2 with the tube body 1. Specifically, an elastic position controlling component (not shown) can be mounted on the outer surface of the cap column 21 for further fixing the electronic cigarette light cap 2 to the tube body 1. In other embodiments, a snap-fit (not shown) may be configured on the outer surface of the cap column 21, and correspondingly, a slot matching the snap-fit is defined in the inner surface of the tube body 1. By a connection between the snap-fit and the slot, the electronic cigarette light cap 2 can engage with the end of the tube body 1 in a detachable way. It can be understood that by forming snap-fit on the inner surface of the tube body and defining the slot matching the snap-fit in the outer surface of the tube body 1, the detachable connection can also be obtained. In the electronic cigarette cap 2, the top cover 22, the cap column 21 and the connecting part are integrated formed, and the air inlet hole 23 defined in the front side of the top cover 22 facilitates the introducing of air, is easy to be processed, and involves a better integrity effect.

The hollow cap column 21 is connected with the air inlet hole 23 to form an airflow path. Air can enter the air inlet hole 23 and flows upward in the cap column 21 to carry smoke, and understandably, the cavity of the hollow cap column 21 is not limited to be shaped as circle, but can also be shaped as square, rectangle or any other ones.

As shown in FIG. 3, the air inlet hole 23 is configured in a center of the front side of the top cover 22, and is shaped as circle.

In the above-mentioned electronic cigarette light cap 2, the total area of the air inlet hole 23 defined in the front side of the top cover 22 is 2 $mm^2$~8 $mm^2$. If the total area is less than 2 $mm^2$, the air inlet hole 23 may be too small. During use processes, air inhalation through the air inlet hole 23 may be difficult, and the electronic cigarette may be damaged. If the total area is greater than 8 $mm^2$, a too large airflow may be generated, which may adversely affect users' smoking feeling. A preferable total area is 5 $mm^2$ in this embodiment.

Based on the structure of the electronic cigarette light cap 2 as above-mentioned, the invention also provides another type of electronic cigarette, which comprises a cigarette holder and a cigarette pipe, wherein the cigarette pipe comprises a tube body 1 and the above-mentioned electronic cigarette light cap 2 engaging with a distal end of the tube body 1. A first gap is formed between the electronic cigarette light cap 2 and the tube body 1 for communicating the electronic cigarette light cap 2 with the tube body 1, and at least one air inlet hole 23 is defined on a front side of the top cover 22 of the electronic cigarette light cap 2. Air can enter an airflow path through the air inlet hole, thus keeping smooth airflows in the electronic cigarette, facilitating processing of the electronic cigarette, and helping reduce smoking noise caused by obstructed airflows.

Figure 4:
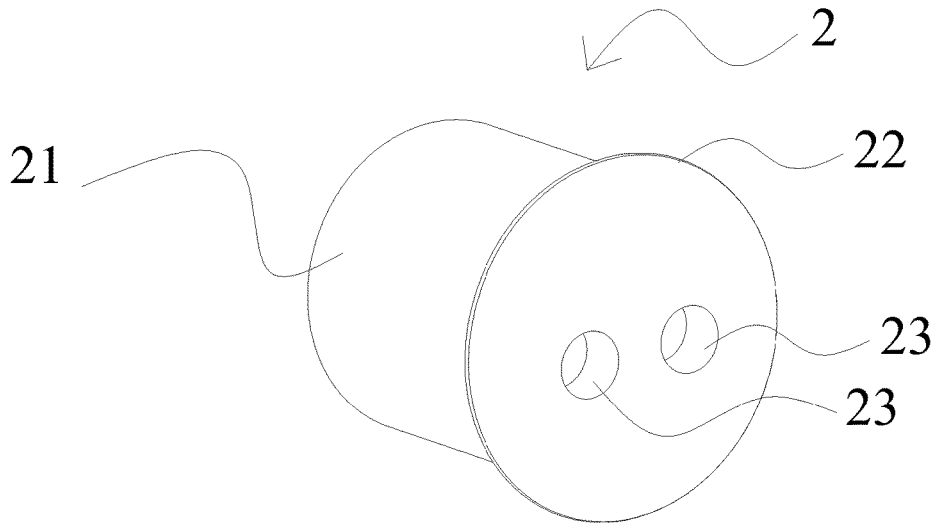
FIG. 4 illustrates a stereoscopic view of an electronic light cap in accordance with a second embodiment of the present invention.
Figure 5:
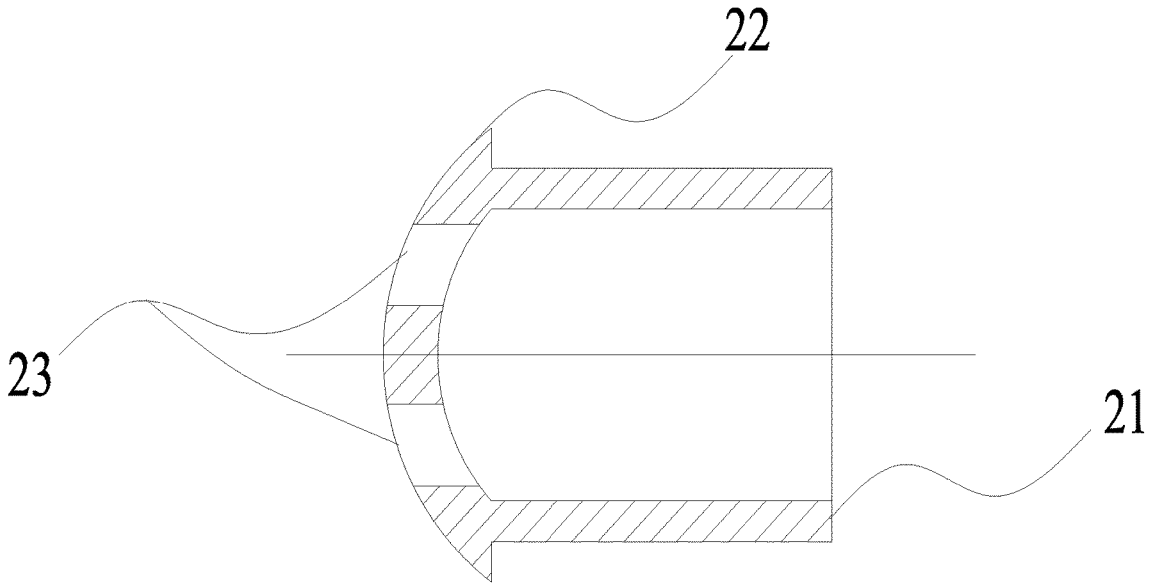
FIG. 5 illustrates a cutaway view of the electronic cigarette light cap shown in FIG. 4.

As shown in FIGS. 4-5, in a second preferable embodiment of the electronic light cap of the invention, the electronic cigarette light cap 2 comprises a top cover 22, and a cap column 21 perpendicularly extending along a bottom side of the top cover 22. As shown in FIG. 4, the cap column 21 in this embodiment is shaped as cylinder, around which an annular stage is formed by the top cover 22, and the top cover 22 is a smooth convexity; an L-shaped connecting part connects the annular stage with the cap column 21, and an outer diameter of the cap column 21 matches an inner diameter of the tube body 1. When the electronic cigarette light cap 2 engages with the tube body 1, an outer surface of the cap column 21 is configured for tightly compressed onto the inner surface of the tube body 1, thereby connecting the electronic cigarette light cap 2 with the tube body 1. Compared with the first embodiment, two air inlet holes 23 are symmetrically defined in a center of the top cover 22. Similar with the first embodiment, the shape of air inlet hole 23 is not limited to circle, and can also be shaped as square, kidney, rhombus, triangle, or polygon, or any other regular or irregular shape, and the specific shape of the air inlet hole can be decided according to practical requirements. Similarly, the total area of the two air inlet holes 23 should be 2 $mm^2$~8 $mm^2$.

As shown in FIG. 5, the cutaway view of the electronic cigarette light cap in the second embodiment is illustrated, wherein, compared with the first embodiment, the top cover 22 of the electronic cigarette light cap 2 is a convexity, as well as an arc-shaped surface, thereby forming a comparatively larger cavity with the cap column 21.

It should be understood that the air inlet hole 23 shall not be limited to be defined symmetrically in the center of the top cover 22, and may also be located at any positions deviated from the center in the front side of the top cover 22.

Figure 6:
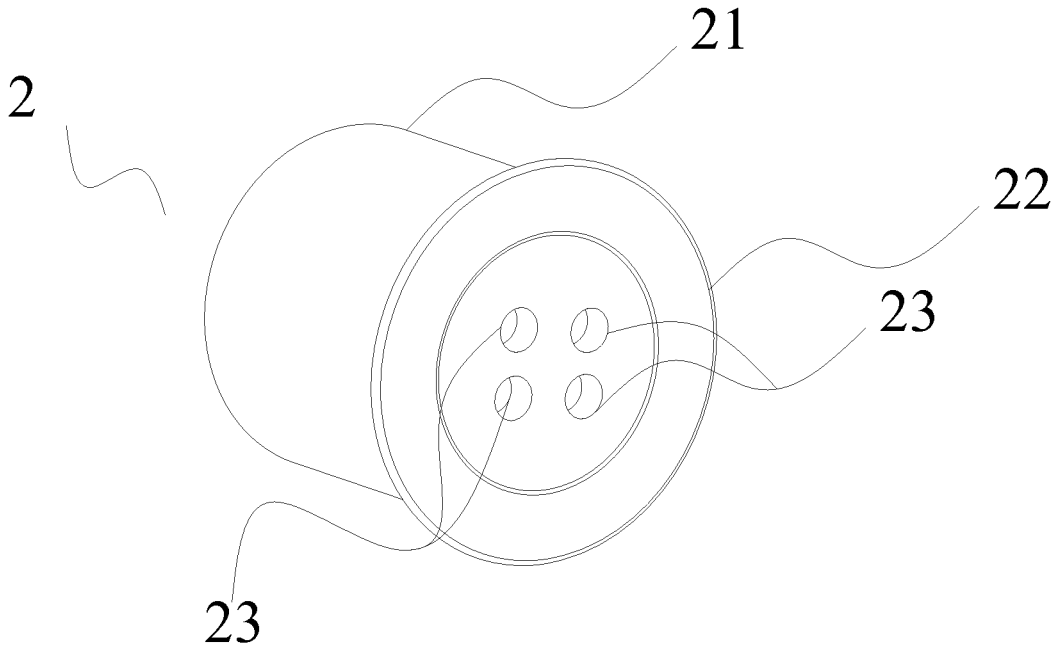
FIG. 6 illustrates a stereoscopic view of an electronic light cap in accordance with a third embodiment of the present invention.
Figure 7:
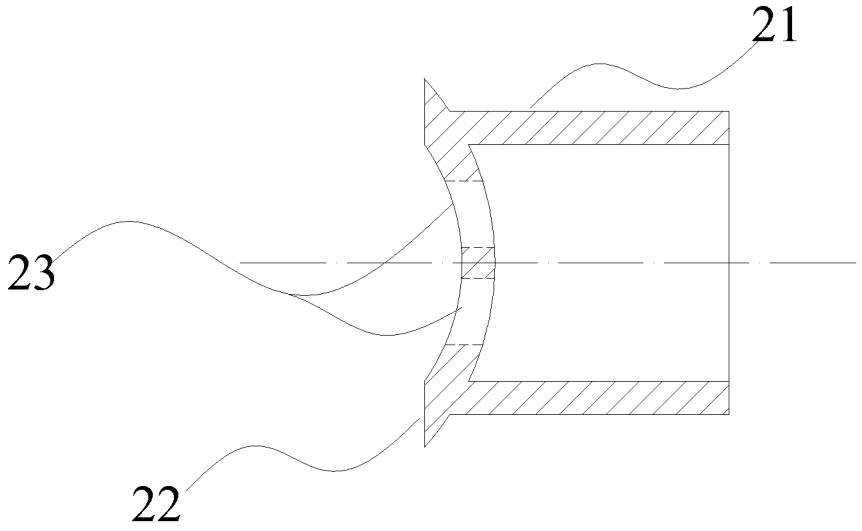
FIG. 7 illustrates a cutaway view of the electronic cigarette light cap shown in FIG. 6.

As shown in FIGS. 6-7, a third preferable embodiment of the electronic cigarette light cap in the invention is illustrated, wherein the electronic cigarette light cap 2 comprises a top cover 22 and a cap column 21 perpendicularly extending along the back side of the top cover 22. The top cover 22 forms a structure of an annular stage around the cap column 21, and in this embodiment, the top cover 22 is a smooth concavity recessing inwards the cap column 21, as well as an arc-shaped surface. As shown in FIG. 6, four air inlet holes 23 are defined in a front side of the top cover 22, equidistantly and symmetrically with each other relative to the center, and it should be understood that the air inlet hole shall not be limited to be symmetrically configured, and may also scatter on the front side of the top cover 22.

It should be understood that the top cover 22 is not limited to the structure of disk shape, smooth concavity or convexity, and can also be a rough plane, convexity or concavity.

Figure 8:
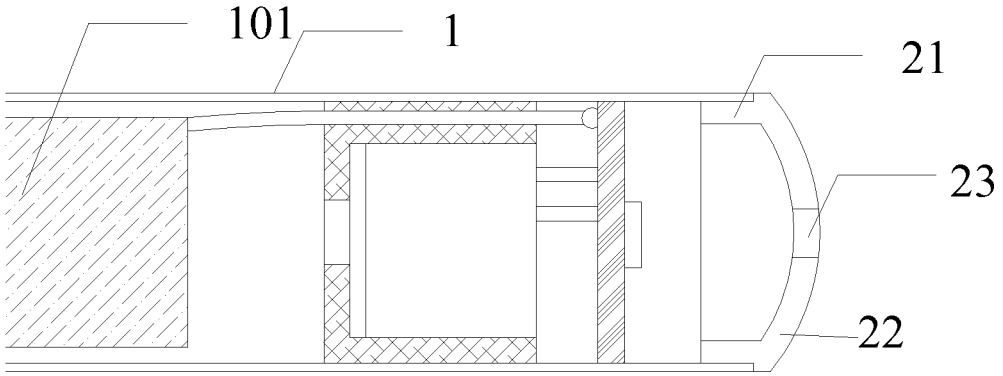
FIG. 8 illustrates a part of a structure of the electronic cigarette in accordance with the second preferable embodiment of the present invention.

FIG. 8 illustrates a part of a structure of the cigarette pipe of the electronic cigarette using the electronic light cap in the invention, wherein the electronic cigarette comprises a cigarette holder (not shown) and a cigarette pipe having a tube body 1 and an electronic cigarette light cap engaging with a distal end of the tube body 1, with a first gap (not shown) in the axial direction between the electronic cigarette light cap and the tube body 1, and the first gap is configured for communicating the electronic cigarette light cap with the tube body 1. The first gap is communicating with an atomizing passageway (not shown) in the tube body 1, and the electronic cigarette light cap comprises a top cover 22 and a hollow and bottomless cap column 21 perpendicularly extending along a bottom side of the top cover 22. The top cover 22 forms an annular stage around the cap column 21. At least one air inlet hole 23 communicating with the cap column 21 is defined in the front side of the top cover 22. Air gets introduced into the first gap (not shown) through the air inlet hole 23, further into the atomizing passageway, thereby forming the airflow path.

As shown in FIG. 8, the connecting part of the top cover 22 and the cap column 21 is L-shaped, and the electronic cigarette light cap may be embedded into the tube body 1, with an outer surface of the cap column 21 tightly compressed onto an inner surface of the tube body 1, and thus the electronic cigarette light cap gets connected to the tube body 1 in a detachable way, with the annual stage adhered to the distal end of the tube body 1.

In the electronic cigarette of FIG. 8, the air inlet hole 23, shaped as circle, square or kidney, is defined in the center of the top cover 22, and the number of the air inlet hole 23 is one in this instance, and the top cover is an arc-shaped convexity protruding outwards from the front side. When using the electronic cigarette, with suction on the cigarette holder, air enters from the inlet hole 23, and for the first gap exists between the tube body and the cap column 21 in axial direction, the air gets introduced into the first gap via the inner cavity of the cap column 21, further reaching the battery device 101; through the second gap (not shown) between the battery device 101 and the inner surface of the tube body 1, the air reaches the atomizer, flowing into the atomizing passageway (not shown) communicated with the second gap, and mixes into the smoke produced in the atomizer, finally reaching the cigarette holder and sucked by the user to simulate smoking feelings. Advantageously, at the distal end of the tube body 1 in the electronic cigarette, a light base is set for arranging LED lights, and through holes (no shown) is defined on the light base in the axial direction of the tube body 1, and the through holes are communicated with the second gap. The airflow path can be explained as follows: from the air inlet hole 23, the air gets introduced into the first gap between the cap column 21 and the tube body 1, passes through the through holes on the light base to reach the battery device 101, and then via the second gap between the battery device 101 and the inner surface of the tube body 1 the air gets to the atomizer, finally into the atomizing passageway in the atomizer.

In the invention, the structure of air inlet hole configured in the front side of the top cover 22, for air entering and perpendicularly flowing into the airflow, may efficiently avoiding smoking noise caused by obstructed airflows, and also help simplify technical processing of the electronic cigarette.

It should be understood that, the number, shape and specific location in the front side of top cover 22, the inlet hole of the electronic cigarette light cap shall not be limited to what mentioned above, neither would the shape of the top cover 22.

While the present invention has been described with reference to preferred embodiments, it will be understood by those skilled in the art that various changes may be made and equivalents may be substituted without departing from the scope of the present invention. But all the changes and equivalents will be included within the scope of the appended claims.

The invention claimed is:

1. An electronic cigarette, comprising a cigarette holder and a cigarette pipe, wherein the cigarette pipe comprises a tube body (1) and an electronic cigarette light cap engaging with an end of the tube body (1), a first gap extending along an axial direction of the tube body (1) formed between the electronic cigarette light cap and the tube body (1) and configured for communicating the light cap with the tube body (1), and the first gap communicating with an atomizing passageway in the tube body (1), wherein the light cap comprises a top cover (22), a hollow and bottomless cap column (21) perpendicularly extending along a back side of the top cover (22), and an annular stage is formed around the cap column (21);

wherein the top cover (22) is an arc-shaped concavity recessing inwards the cap column (21); four air inlet holes (23) are defined in a front side of the top cover (22) and defined equidistantly and symmetrically with each other relative to the central axis of the top cover (22), and the air inlet holes (23) communicate with the cap column (21); air enters the atomizing passageway via the air inlet holes (23) and the first gap, and an airflow path is formed;

wherein the four air inlet holes (23) are defined to deviate from the central axis of the top cover (22), and a total area of the air inlet holes (23) is 2 $mm^2$~8 $mm^2$.

2. The electronic cigarette of claim 1, wherein an L-shaped connecting part connects the annular stage with the cap column (21).

3. The electronic cigarette of claim 1, wherein an outer surface of the cap column (21) is configured for tightly attaching to an inner surface of a tube body (1) of the electronic cigarette.

4. The electronic cigarette of claim 3, wherein the top cover (22), the cap column (21), and the connecting part are formed by integral forming.

5. The electronic cigarette of the claim 1, wherein each of the air inlet holes (23) is shaped as one of square, circle, triangle, polygon and kidney.

* * * * *